US005094175A

United States Patent [19]

Christie

[11] Patent Number: 5,094,175

[45] Date of Patent: Mar. 10, 1992

[54] MODULAR PALLET ARRANGEMENT

[76] Inventor: Eugene P. Christie, 555 Edgemont La., Park Ridge, Ill. 60068

[21] Appl. No.: 668,938

[22] Filed: Mar. 13, 1991

[51] Int. Cl.[5] ..... B65D 19/12

[52] U.S. Cl. ..... 108/56.1; 108/901; 108/57.1

[58] Field of Search ..... 108/57.1, 56.1, 56.3, 108/901, 51.1

[56] References Cited

U.S. PATENT DOCUMENTS

| | | | |
|---|---|---|---|
| 3,650,224 | 3/1972 | Petix et al. | 108/901 X |
| 3,664,271 | 5/1972 | Wolder et al. | 108/901 X |
| 3,857,342 | 12/1974 | Johns | 108/56.1 X |
| 3,868,915 | 3/1975 | Hafner | 108/901 X |
| 3,902,692 | 9/1975 | Skinner | 108/901 X |
| 4,051,787 | 10/1977 | Nishitani et al. | 108/901 X |
| 4,128,253 | 12/1978 | Powers | 108/56.1 X |
| 4,597,338 | 7/1986 | Kreeger | 108/902 X |
| 4,895,080 | 1/1990 | Thomas | 108/56.1 |

FOREIGN PATENT DOCUMENTS

| | | | |
|---|---|---|---|
| 296792 | 12/1988 | European Pat. Off. | 108/901 |

*Primary Examiner*—Peter A. Aschenbrenner
*Attorney, Agent, or Firm*—Richard W. Carpenter

[57] ABSTRACT

A modular pallet arrangement formed of a pair of upper and lower pallet sections each of which includes plurality of molded plastic lower pallet units that are adapted to be interconnected in telescoping interlocking relation to form a complete pallet. Certain of the lower units are adapted to be connected to more than one upper unit, so they can join adjacent upper units to each other.

13 Claims, 5 Drawing Sheets

MODULAR PALLET ARRANGEMENT

BACKGROUND OF THE INVENTION

1. Field of the Invention:

This invention relates to pallets used in the transportation and warehousing of industrial products, and more particularly to an improved modular pallet arrangement comprising a plurality of separate pallet units formed from recycled and recyclable molded plastic material and adapted to be joined to each other in interlocking relationship both horizontally and vertically.

2. Description of Background Art:

A background art search directed too the subject matter of this application conducted in the United States Patent and Trademark Office disclosed the following Letters Patent:

U.S. Pat. Nos. 3,307,504, 3,650,224, 3,651,769, 3,664,271, 3,857,342, 4,189,125, 4,597,338, 4,694,962, 4,843,976,

German Patents 2,106,234, 2,231,178,

French Patent 2,362,053.

No patent was found disclosing a modular pallet arrangement comprising a pair of upper and lower sections, each of which are formed from a plurality of molded plastic units, wherein the lower section units include cup-like connector members that connect the lower section units to the upper section units, and also connect adjacent upper section units to each other.

SUMMARY OF THE INVENTION

It is an object of the present invention to provide an improved pallet arrangement comprising a pair of upper and lower sections each of which include a plurality of modular pallet units that can be formed of recycled and recyclable plastic material.

Another object of the invention is the provision of a modular pallet arrangement comprising a plurality of pallet units each of which are smaller than the entire pallet, so as to be less expensive to manufacture, transport, and store.

Another object of the invention is the provision of a modular pallet arrangement comprising upper and lower sections each formed of plurality of units having interlocking engagement with each other.

A more specific object of the invention is the provision of a modular pallet arrangement of the type described, wherein the lower section units are provided with connector members adapted to have telescoping engagement with connector members of the upper section units in such a way that the connector members of the lower section units not only connect the lower section units to the upper section units, but also connect the adjacent upper section units to each other.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
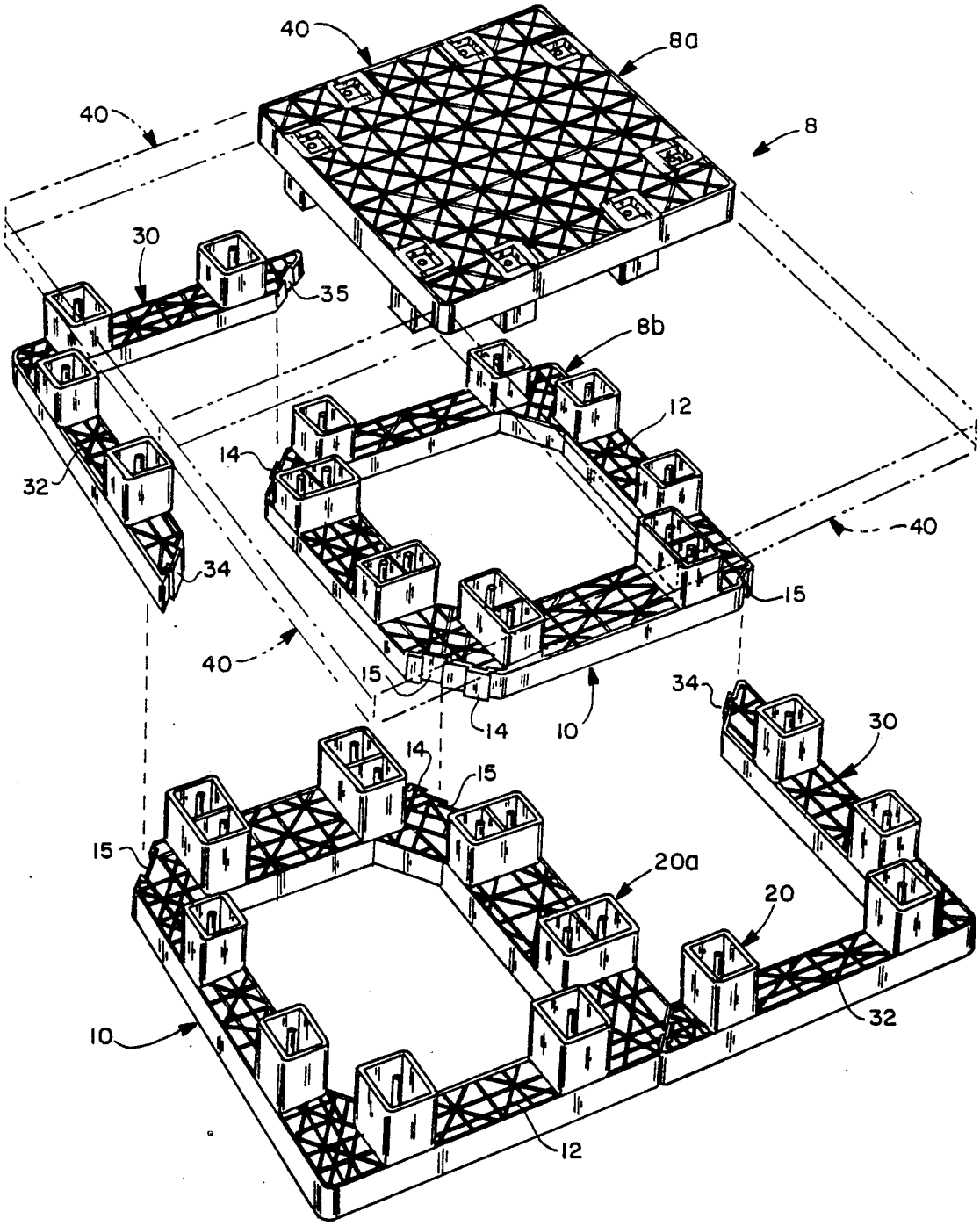
FIG. 1 is a fragmentary, exploded, perspective view of a modular pallet arrangement embodying features of the present invention, but shown with three of the upper sections removed.

Turning now to the drawings for a better understanding of the invention, it will be seen that the pallet arrangement indicated generally at 8 in FIG. 1 comprises a pair of upper and lower sections **8*a* and 8*b***, respectively, each of which includes a plurality of separate pallet units that can be formed of recycled and recycable molded plastic material.

The arrangement of the present invention substantially reduces pallet costs in several ways. The pallet is formed of separate modular units which are relatively small and require less space to ship and store. Since the individual units are each substantially smaller than complete pallets, they can be formed on plastic molding equipment that is smaller and therefore far less expensive than the type of molding equipment necessary to form a full sized pallet. Also, the units can be formed entirely of recycled material, which of course is highly desirable from an economic as well as an environmental viewpoint.

The lower section **8*b* of the pallet comprises a pair of generally rectangular major units 10 and a pair of generally L-shaped minor units 30** which are secured to each other in interlocking relationship, with corresponding units positioned diagonally opposite each other.

Figure 2:
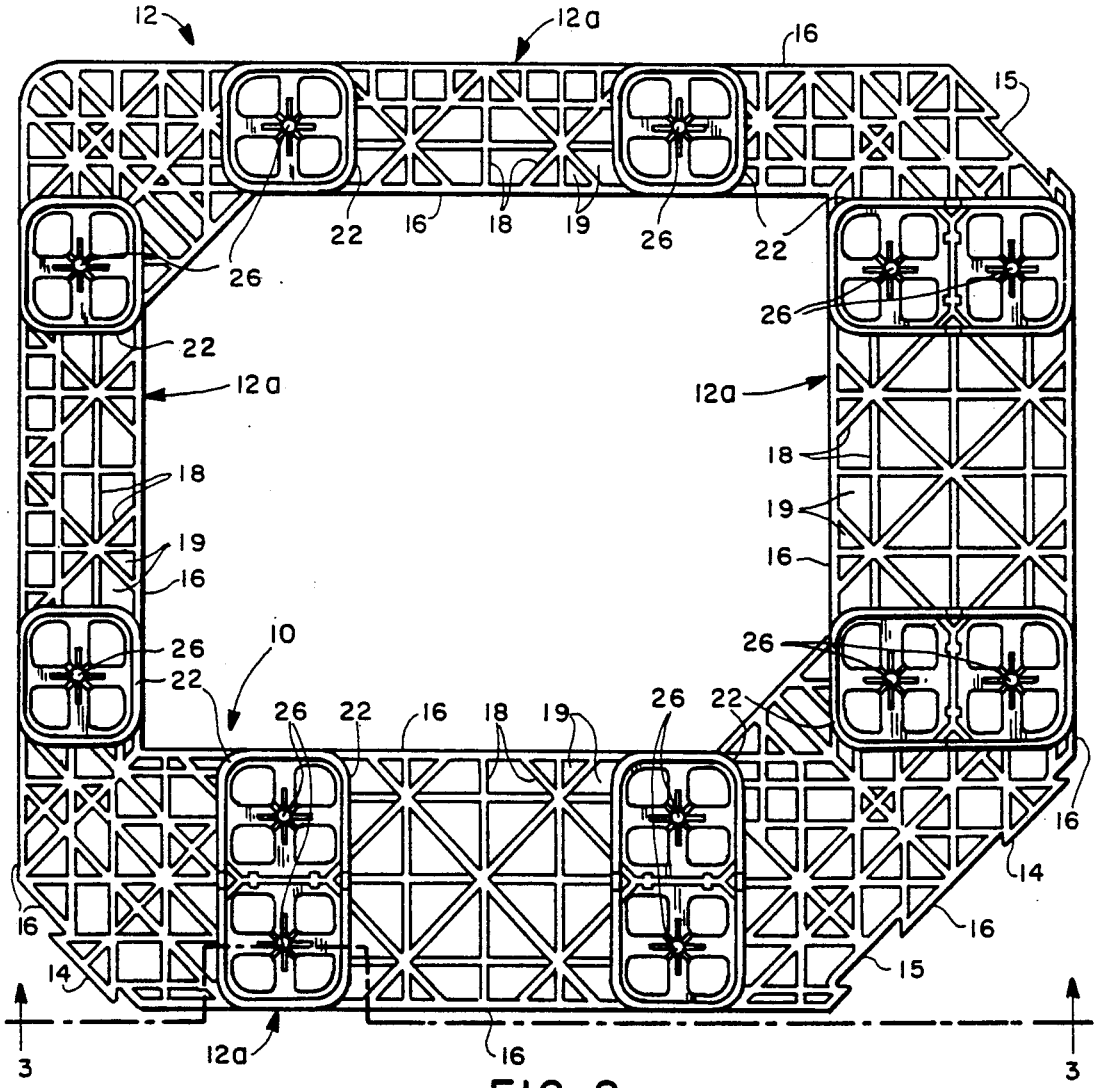
FIG. 2 is a top plan view of one type of lower section pallet unit illustrated in FIG. 1.
Figure 3:
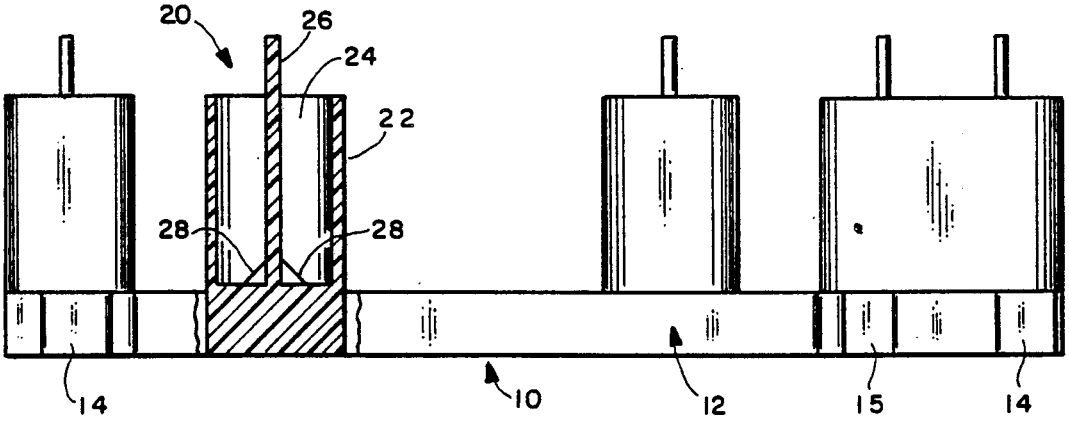
FIG. 3 is a fragmentary, vertical, sectional view taken on line 3—3 of FIG. 2.
Figure 4:
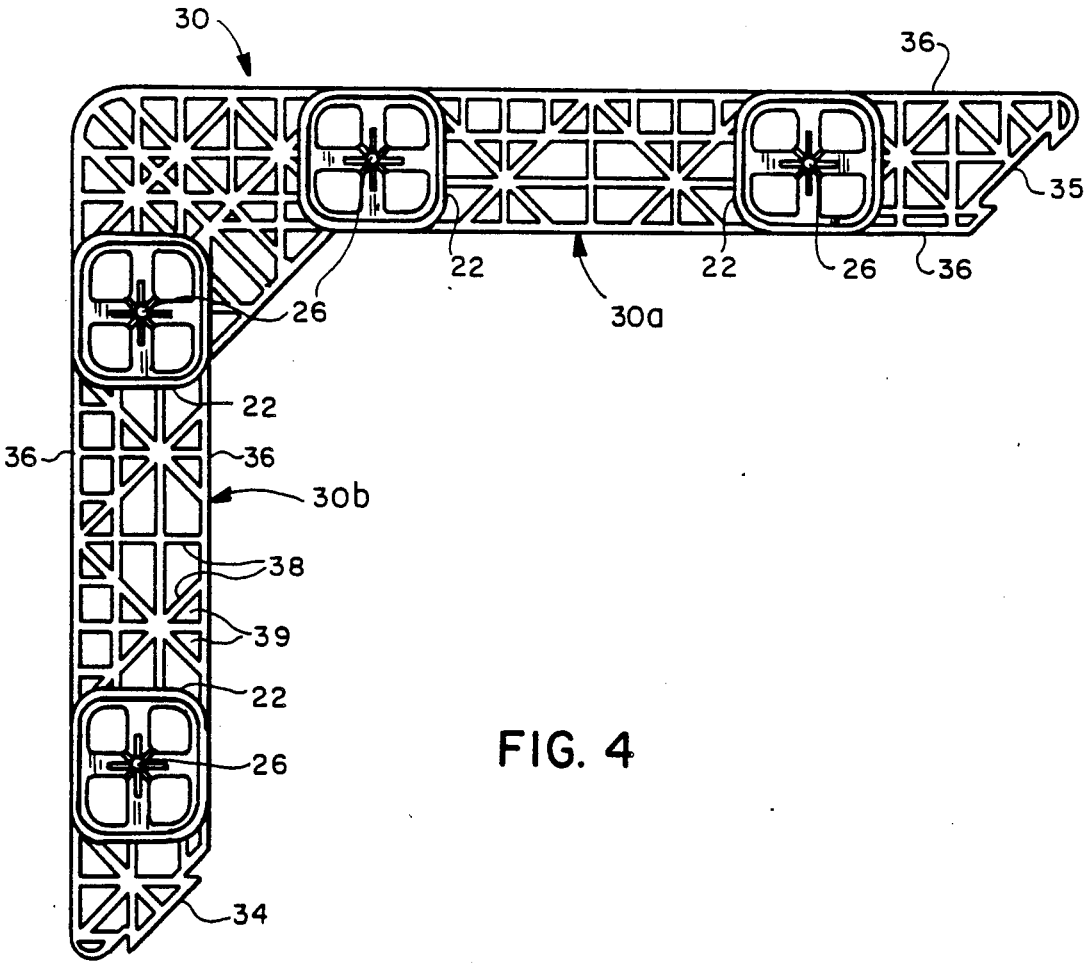
FIG. 4 is a top plan view of another type of lower section pallet unit illustrated in FIG. 1.

As best seen in FIGS. 2 and 3, each of the major lower units 10 includes a base member 12 and a plurality of integral lower connector members 20 and **20*a***.

Major lower unit base members 12 each comprise four integral, flat, elongated bar-like base elements **12*a*** joined at their ends to form a generally rectangular structure open in the center.

Each base element **12*a* includes a pair of continuous, vertical, inner and outer side walls 16 interconnected by a plurality of integral, vertical, internal struts 18 that form, with the side walls, openings 19** which reduce the weight, and therefore the cost of the pallet units.

At three of the corners of each base member outer side wall 16 presents alternating tongues 14 and grooves 15 adapted to provide an interlocking connection with adjacent major and/or minor lower pallet units.

Figure 5:
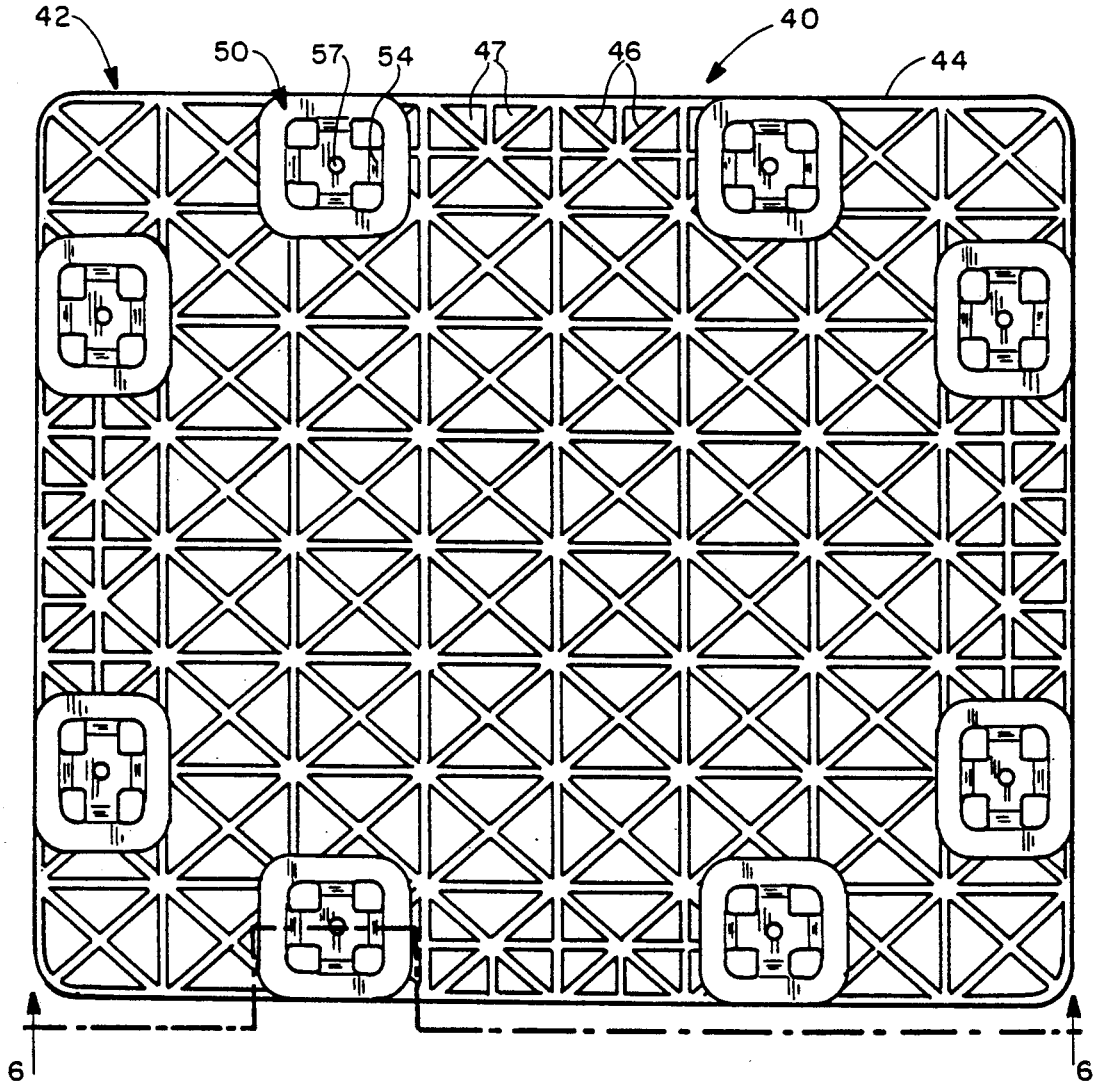
FIG. 5 is a top plan view of the upper section pallet unit illustrated in FIG. 1.
Figure 6:
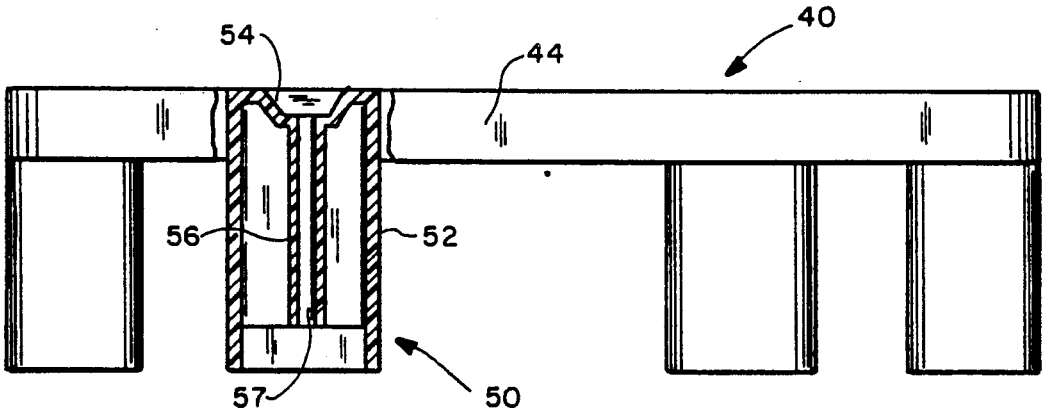
FIG. 6 is a fragmentary, vertical, sectional view taken on line 6—6 of FIG. 5.

Turning now to FIGS. 5 and 6, it will be seen that the minor lower units 30 each include a pair of integral, flat, elongated bar-like elements 32*a* joined at their ends to form a generally L-shaped structure.

The structure of the base elements 32*a* is similar to that of the major unit base elements 12*a* and includes a continuous, vertically extending outer side wall 36 with portions interconnected by a plurality of integral, vertical, internal struts 38 that form, with the outer wall, openings 39.

At its free ends the outer wall 36 of each minor unit base element 32*a* is also provided with a plurality of alternating tongues 34 and grooves 35 adapted for interlocking engagement with corners of adjacent major units.

As can be seen in several of the views, both the major and minor lower section pallet units are provided with integral cup-like lower connector members adapted for telescoping engagement with complementary connector members of the upper section units in a manner hereinafter described.

Each of the lower connector members includes a continuous, peripheral outer wall 22 and an integral bottom wall 24 which form a cup-like structure open at the top. The lower connector members are of two types: single and double.

Members 20 are single units, with one column or shaft 26, extending upwardly from bottom wall 24 above side wall 22 and adapted for telescoping engagement with a complementary column or shaft of an upper section unit connector member 50.

Figure 9:
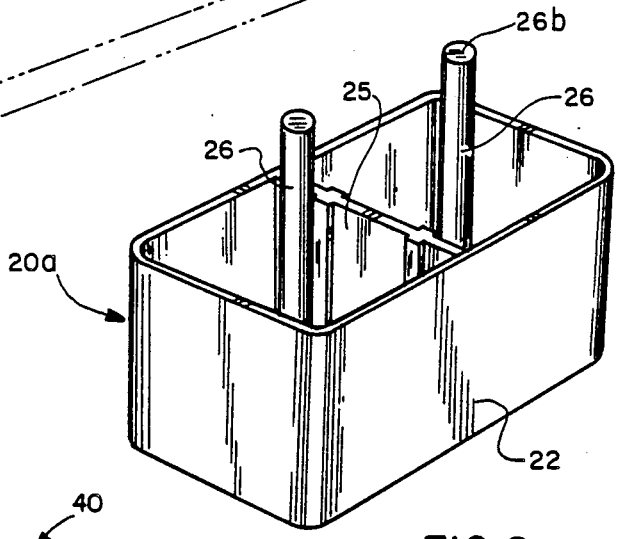
FIG. 9 is a perspective view of a lower section connector member of the type illustrated in FIG. 8.

Members 20*a*, illustrated in FIG. 9, are double units, with two columns or shafts 26 adapted for telescoping engagement with complementary columns or shafts 56 of upper connector members 50 of two separate, adjacent, upper section units 40. Each of the double units 20*a* preferably includes a reinforcing wall 25 extending between the columns 26 from one portion of the side wall 22 to another portion.

These double unit lower connector members not only function to connect the lower section pallet units to the upper section pallet units, but they also provide an interlocking connection between pairs of adjacent upper section pallet units in a manner hereinafter described and illustrated in FIG. 7.

Thus, as best seen in FIG. 1, in order to form a complete lower section 8*a* of the pallet arrangment, two major units 10 and two minor units 30 are placed together in interlocking relationship with similiar units positioned diagonally opposite each other. The double lower connector members 20*a* are so designed that each underlies upper connector members 50 of two separate, adjacent, abutting upper section units.

Again referring to FIG. 1, athough the upper section of the pallet arrangement comprises four generally identical upper units, for purposes of clarity, only one pallet unit, indicated generally at 40, is illustrated in the drawings.

Upper section pallets units 40, are somewhat similiar to the lower section units, each comprising a base member 42 and a plurality of upper connector members 50.. The base members are preferably square, but are constructed in a manner similar to the lower section pallet unit base elements. Each unit includes a continuous, vertical outer side wall 44 having portions interconnected by a plurality of integral, internal vertical struts 46 which define a grid structure with a plurality of openings 47 that lessen the weight and the cost of the units.

The upper connector members 50 are located entirely between the planes defined by the upper and lower surfaces of the upper units and do not extend beyond those planes.

Also the upper connector members are all single units that include a continuous side wall 52 and an integral top wall 54 that form a cup-like structure open toward the bottom. Upper connector members each include a central shaft or column 56 having an internal bore 57 adapted to receive the shaft 26 of a mating lower connector member 20 or 20*a*, as seen in FIG. 7.

In order to assemble a pallet arrangement, the first step is to erect the lower section by placing two major units 10 and two minor units 30 in interlocking engagement with each other, as illustrated in FIG. 1. After this has been done the upper section can be formed and, at the same time, joined to the lower section.

Figure 10:
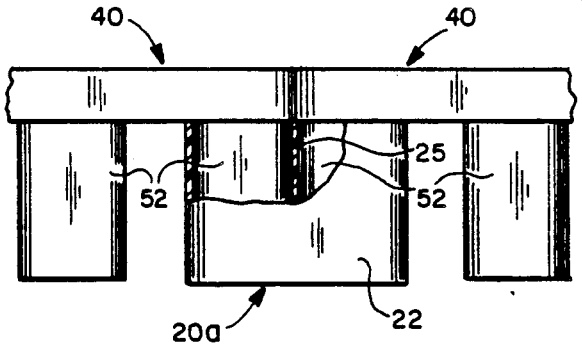
FIG. 10 is a fragmentary side elevational view, partly in vertical section, illustrating the interlocking relationship between portions of the upper and lower pallet section units illustrated in FIG. 8.

To form the upper section, four upper units are placed over the four lower units. As previously mentioned and as illustrated in FIGS. 1 and 10, certain of the lower connector members are double members, so that one portion of the double member 20*a* has telescoping engagment with a connector member 50 of one upper pallet unit, while the other portion has telescoping engagment with a connector member of an adjacent upper pallet unit. This not only serves to connect the upper and lower section units to each other, but to connect adjacent upper section units to each other.

When the upper and lower sections have been joined to each other in telescoping relation, as previously described, they can be easily locked together by deforming the upper ends 26*a* of the lower connector member shafts 26 to prevent related upper and lower connector members from accidentally separating.

Of course, if one unit of the pallet arrangement breaks and has to be replaced, upper ends 26*a* of the appropriate units can fe filed away to permit removal.

Figure 7:
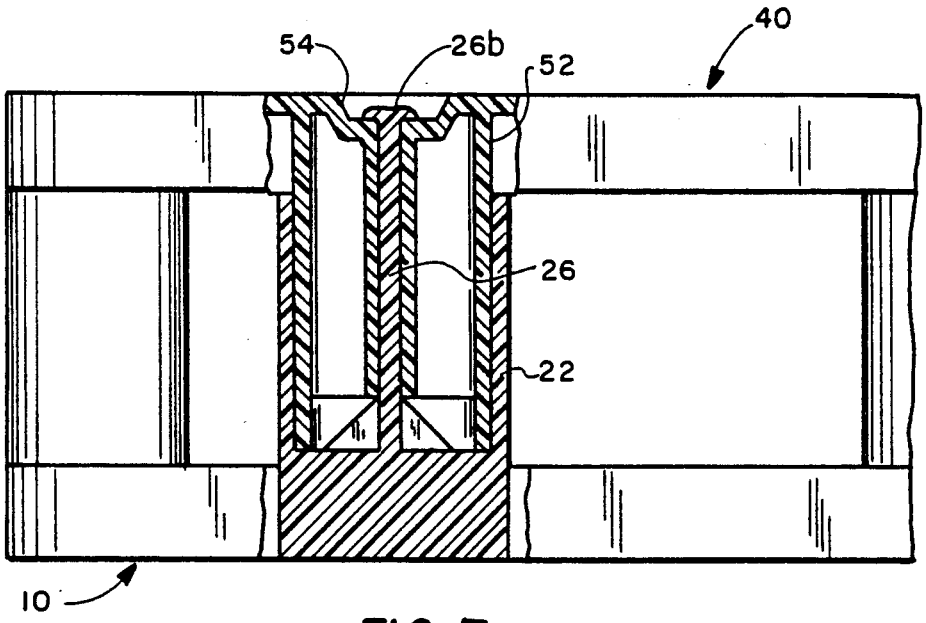
FIG. 7 is a fragmentary side elevational view, partly in vertical section, illustrating the interlocking relationship between portions of the upper and lower pallet section units illustrated in FIG. 1.

As best seen in FIG. 7, there is sufficient space between the base members of the upper and lower sections and between the lower connector members to accomodate receipt of a lift fork.

Thus, it will be appreciated that the invention provides a unique pallet arrangment wherein a pallet can be made from a plurality of interlocking units formed from recycled and recyclable molded plastic material.

Figure 8:
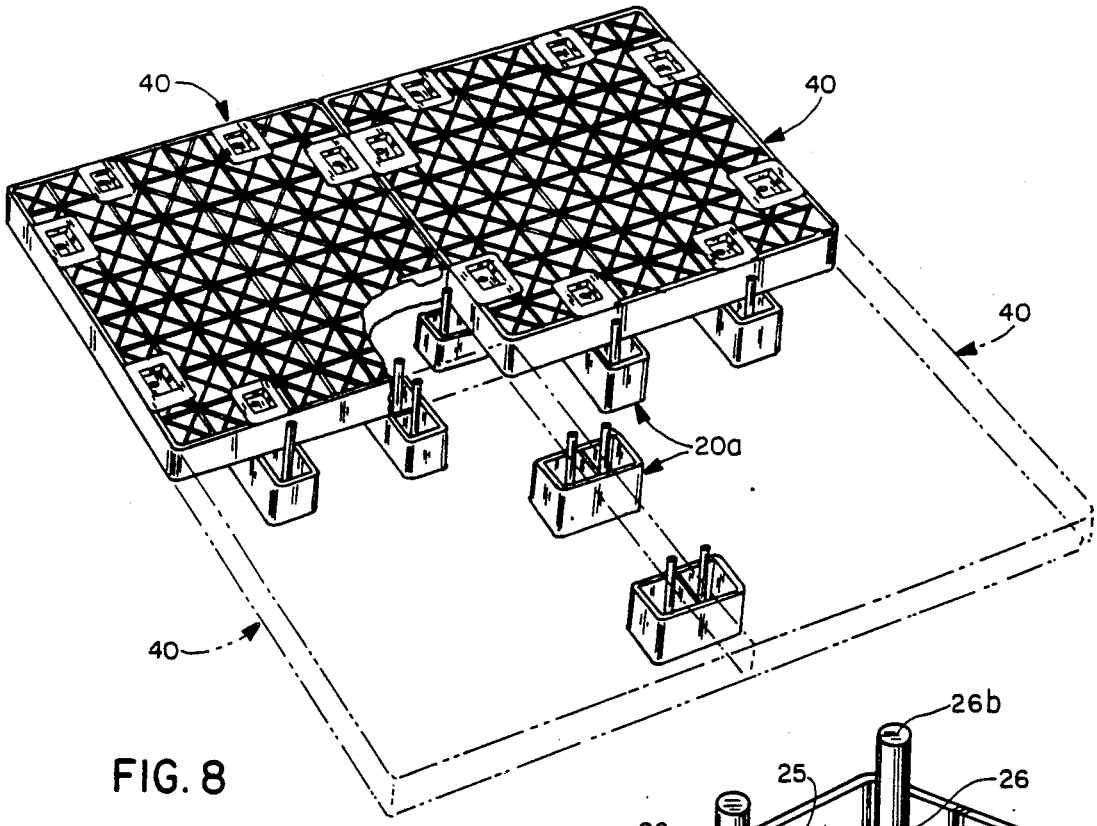
FIG. 8 is a perspective view similar to that of FIG. 1, but illustrating a modified form of the invention, and shown with two of the four upper section units removed.

Turning now to FIG. 8 of the drawings, it will be seen that a modified form of the invention is disclosed.

In this embodiment, upper section 8*a* of the pallet arrangment is exactly the same of the previously described embodiment and comprises four similar or identical upper pallet units each indicated generally at 40. Again, for purposes of clarity, only two of four upper units are shown in FIG. 8.

In this embodiment of the invention, the lower section of the pallet comprises only the lower connector members alone without any base members. Each of these lower connector members is a double unit 20*a*, as illustrated in FIG. 9, and functions to connect connect adjacent upper pallet units to each other, as best illustrated in FIGS. 8 and 10.

It will be appreciated that the alternate embodiment of the invention illustrated in FIG. 8 and just previously described, is lighter in weight and less expensive than the first described embodiment of the invention. It, however, is capable of functioning as a complete pallet arrangment.

In this arrangement sufficient space is provided between the connector members of the lower pallet section to permit insertion of the forks of lift devices, so that the pallets can be easily grasped and moved in a conventional manner.

What is claimed is:

1. A modular pallet arrangement formed of a plurality of molded plastic units adapted to be interconnected in interlocking relation to form a complete pallet, said arrangement comprising:

(a) an upper section having four generally similiar rectangular upper units, each unit including:
  (i) a flat, grid-like, base member presenting upper and lower surfaces that define parallel, vertically spaced, upper and lower planes;
  (ii) a plurality of integral, horizontally spaced, downwardly facing, cup-like, upper connector members;

(b) a lower section having a pair of L-shaped units and a pair of rectangular, but open in the center, units arranged and disposed for interlocking engagement with each other and with said upper section units, the lower section units each including:
  (i) a plurality of flat, elongated, grid-like, base elements joined at adjacent ends to form a base member presenting upper and lower surfaces that define a pair of parallel, vertically, spaced upper and lower planes;
  (ii) a plurality of integral, horizontally spaced, upwardly facing, cup-like, lower connector members;

(c) the connector members of said upper and lower section units being arranged and disposed for telescoping engagement with each other to provide interlocking connections between adjacent upper section units and also between adjacent upper and and lower section units.

2. A modular pallet arrangement according to claim 1, wherein certain of said lower connector members each includes;

(i) a hollow body open at the top that is arranged and disposed to telescopingly receive hollow bodies of two separate adjacent upper section unit upper connector members;

(ii) a pair of laterally spaced, upwardly projecting, columns arranged and disposed to be telescopically received within hollow shafts projecting downwardly from said two upper connector members.

3. A modular pallet arrangement according to claim 1, wherein each of said connector members comprises a hollow body element and at least one integral, internal, column element arranged and disposed for telescoping engagement with corresponding elements of a related connector member.

4. A modular pallet arrangement according to claim 3, wherein certain of said connector members include a pair of column elements spaced laterally from each other and adapted for telescoping engagement with column elements of two separate adjacent related connector members.

5. A modular pallet arrangement according to claim 1, wherein a body element of one connector member is received within the body element of a related telescoping connector member while a column element of said related telescoping connector member is received within a column element of said one connector member.

6. A modular pallet arrangement according to claim 1, wherein certain of said lower connector members are adapted for telescoping engagement with connector members of more that one upper section pallet unit at the same time.

7. A modular pallet arrangement according to claim 1, wherein certain of said lower unit base members have tongue and groove-type interlocking interconnection with adjacent lower unit base members.

8. A modular pallet arrangement formed of a plurality of molded plastic units adapted to be interconnected in interlocking relation to form a complete pallet, said arrangement comprising:

(a) an upper section having a plurality of generally similiar upper units, each including a grid-like, base member having a flat central portion and having at locations adjacent the periphery of said central portion a plurality of integral, downwardly extending, upper connector members;

(b) each of said upper connector members including a continuous side wall forming a cup-like body having a vertical shaft projecting downwardly within said side wall;

(c) a lower section having a plurality of units arranged and disposed for interlocking engagement with said upper section units, each lower section unit including a grid-like base member having a flat central portion and having at locations adjacent the ends of said central portion a plurality of integral, upwardly extending lower connector members;

(d) each of said lower connector members including a bottom wall and a continuous side wall extending upwardly therefrom to form a cup-like body open at the top and having a pair of laterally spaced shafts projecting upwardly from said bottom wall;

(e) the lower section unit connector members being arranged and disposed so that the shafts of each will be in full telescoping engagement with individual shafts of two separate, adjacent upper section unit connector members to provide interlocking connections between adjacent upper section units and also between related upper and lower section units.

9. A modular pallet arrangement according to claim 8, wherein certain of said lower unit base members have tongue and groove-type interlocking interconnection with adjacent lower unit base members.

10. A modular pallet arrangement formed of a plurality of molded plastic units adapted to be interconnected in interlocking relation to form a complete pallet, said arrangement comprising:

(a) an upper section having a plurality of generally similar upper units, each including a grid-like, base member having a flat central portion and having at locations adjacent the periphery of said central portion a plurality of integral, downwardly extending, upper connector members;

(b) each of said upper connector members including a top wall and a continuous side wall depending therefrom to form a cup-like body open at the bottom and having a vertical shaft projecting downwardly from said top wall;

(c) a lower section comprising a plurality of lower connector members arranged and disposed for interlocking engagement with said upper section units;

(d) each of said lower connector members including a bottom wall and a continuous side wall extending upwardly therefrom to form a cup-like body open at the top and having a pair of laterally spaced shafts projecting upwardly from said bottom wall;

(e) said lower connector members being arranged and disposed so that the shafts of each will be in full telescoping engagement with individual shafts of two separate, adjacent upper section unit connector members to provide interlocking connections between adjacent upper section units and also between upper and and lower sections.

11. A modular pallet arrangement formed of a plurality of molded plastic units adapted to be interconnected in interlocking relation to form a complete pallet, said arrangement comprising:

(a) an upper section having a plurality of generally similar upper units, each unit including:
  (i) a flat, grid-like, base member;
  (ii) a plurality of integral, horizontally spaced, downwardly facing, cup-like, upper connector members;

(b) a lower section having a plurality of units arranged and disposed for interlocking engagement with each other and with said upper section units, the lower section units each including:
  (i) a plurality of flat, elongated, grid-like, base elements joined at adjacent ends to form a base member;
  (ii) certain of said lower unit base members comprising only two base member elements, which are arranged to form an L-shape, and other of said lower unit base members comprising four base member elements, which are arranged to form the shape of a rectangle open in the center;
  (iii) a plurality of integral, horizontally spaced, upwardly facing, cup-like, lower connector members extending between said last mentioned planes and upwardly beyond the upper plane;

(c) the connector members of said upper and lower section units being arranged and disposed for telescoping engagement with each other to provide interlocking connections between adjacent upper section units and also between adjacent upper and lower section units.

12. A modular pallet arrangement according to claim 8, wherein certain of said lower connector members are arranged and disposed to telescopingly receive two separate adjacent upper section unit upper connector member bodies and wherein both shafts of certain of said lower connector members are arranged and disposed to be telescopingly received within hollow shafts projecting downwardly from said two separate upper connector members.

13. A modular pallet arrangement according to claim 10, wherein certain of said lower connector members are arranged and disposed to telescopingly receive two separate adjacent upper section unit upper connector member bodies and wherein both shafts of certain of said lower connector members are arranged and disposed to be telescopingly received within hollow shafts projecting downwardly from said two separate upper connector members.

* * * * *